US011123782B2

(12) United States Patent
Pitney

(10) Patent No.: US 11,123,782 B2
(45) Date of Patent: Sep. 21, 2021

(54) VERSATILE TUBING STRAIGHTENER

(71) Applicant: Paul T. Pitney, Wildwood, MO (US)

(72) Inventor: Paul T. Pitney, Wildwood, MO (US)

(73) Assignee: Husky Corporation

( * ) Notice: Subject to any disclaimer, the term of this patent is extended or adjusted under 35 U.S.C. 154(b) by 61 days.

(21) Appl. No.: 16/602,962

(22) Filed: Jan. 6, 2020

(65) Prior Publication Data

US 2020/0215594 A1 Jul. 9, 2020

Related U.S. Application Data

(60) Provisional application No. 62/917,981, filed on Jan. 9, 2019.

(51) Int. Cl.
*B21D 3/05* (2006.01)
*B21D 3/04* (2006.01)

(52) U.S. Cl.
CPC ..... *B21D 3/045* (2013.01); *B21D 3/05* (2013.01)

(58) Field of Classification Search
CPC ... B21D 3/00; B21D 3/02; B21D 3/04; B21D 3/045; B21D 3/05; B21F 1/02; B21F 23/00; B21F 23/02
See application file for complete search history.

(56) References Cited

U.S. PATENT DOCUMENTS 1,914,975 A * 6/1933 Nigro ..... B21F 1/02 72/164
3,568,485 A 3/1971 Mandala, Jr.
3,595,277 A * 7/1971 Lefever ..... B21D 3/05 140/147
3,857,266 A * 12/1974 Wilke ..... B21F 1/023 72/79
3,998,083 A 12/1976 Dilling
4,116,037 A 9/1978 Honeycutt
4,334,418 A * 6/1982 Grandell ..... B21D 3/02 140/147
4,475,373 A 10/1984 Ikenberry
D276,436 S 11/1984 Ikenberry
4,494,394 A 1/1985 Nilsson
(Continued)

FOREIGN PATENT DOCUMENTS

EP 3272436 A1 * 1/2018 ..... B21D 3/05
FR 2679801 A1 * 2/1993 ..... B21F 1/02
GB 2216443 A * 10/1989 ..... B21D 3/05

*Primary Examiner* — Edward T Tolan
(74) *Attorney, Agent, or Firm* — Paul M. Denk

(57) ABSTRACT

A hand-held tool for straightening tubing such as brake fluid lines in vehicles, the tool provides a housing having an outer covering, internally thereof, a series of sets of rollers, that are adjustable radially, supported by end frames, and intermediate the rollers and the outer covering is an adjuster ring, shiftable longitudinally within the housing, operatively associated with the rollers, such that when the adjuster ring is pulled outwardly, longitudinally, from the tool housing, the rollers shift radially outwardly, for accommodating larger tubing, and when the adjuster ring is pushed inwardly of the housing, the rollers are forced inwardly against smaller diameter tubing, in preparation for its straightening. A sector of the tool, usually along a quadrant, is opened from one end to the other of the tool, so as to allow the tool to be applied to the tubing to be straightened, anywhere along its length, and not only at its ends.

14 Claims, 4 Drawing Sheets

(56) References Cited

U.S. PATENT DOCUMENTS

| | | | | |
|---|---|---|---|---|
| 4,534,197 | A | 8/1985 | Woolley | |
| 4,711,112 | A | 12/1987 | Nilsson | |
| 4,763,504 | A | 8/1988 | Nilsson | |
| 5,125,905 | A | 6/1992 | Wright et al. | |
| 5,309,746 | A | 5/1994 | Abbey, III | |
| 5,442,946 | A | 8/1995 | Yokoo et al. | |
| 5,676,010 | A * | 10/1997 | College | B21D 3/05 72/162 |
| 6,279,363 | B1 | 8/2001 | Averbuch et al. | |
| 6,354,126 | B1 | 3/2002 | Small et al. | |
| 6,494,353 | B2 | 12/2002 | Small et al. | |
| 6,691,544 | B2 | 2/2004 | Steudle et al. | |
| 7,347,257 | B2 | 3/2008 | Van Way | |
| 7,909,106 | B2 | 3/2011 | Van Way | |
| 8,652,106 | B2 | 2/2014 | Schweikert et al. | |
| 8,783,085 | B2 | 7/2014 | Kuroiwa et al. | |
| 9,440,271 | B2 | 9/2016 | Kipping et al. | |
| 9,751,121 | B2 | 9/2017 | Murphy | |
| 10,005,115 | B2 | 6/2018 | Badea et al. | |
| 2002/0162373 | A1 | 11/2002 | Schramm et al. | |

* cited by examiner

VERSATILE TUBING STRAIGHTENER

CROSS REFERENCE TO RELATED APPLICATION

This is a regular letters patent application that claims priority to the provisional patent application having Ser. No. 62/917,981, filed on Jan. 9, 2019;

FIELD OF THE INVENTION

The field of this invention relates to the processing of tubing in preparation for its installation and usage in a variety of applications, including the automotive field, and more specifically pertains to an apparatus for straightening tubing, from the coil or roll form, when applying it for automotive purposes, such as in the installation of new or replacement of brake lines, when installing or replacing brakes, in various vehicles.

BACKGROUND OF THE INVENTION

In the application and usage of tubing, particularly that which may be used in automotive repair, such as installing new or replacement brake lines, in various vehicles, usually such tubing, which normally is made of copper-nickel alloy, or stainless steel, comes in coils of such material usually around eighteen inches in diameter. Thus, with the use of such tubing, as well as the individuals who repair their own vehicles, may have to replace the faulty or leaking brake lines, for such vehicles. Usually, such tubing, as used for these purposes, has an outer diameter of approximately $3/16^{th}$ inch, 1/4 inch, $5/16^{th}$ inch, or $3/8^{th}$ inch, in their dimensions. And, as such, during the application of these coils, the tubing must be straightened into a proper shape to be fitted up to the vehicle chassis and fastened at the appropriate locations. Usually, these coils of tubing must be straightened into the proper shape, and be fit up into the vehicle chassis, during usage. This necessitates the use of a tool to straighten the tubing, as it comes off of the coil or roll. There are tubing straighteners available, many of them do generally consist of sets of rolling wheels, and which do feature concave circumferential surfaces, which forces the tubing from a curved orientation into a more straightened shape.

During the application and usage of such tubing, such as in the application of brake lines, the tool of this current invention allows the user to straighten the tube while one end is already installed and attached to the vehicle, and the other end is still upon the coil. This requires a more specialized type of tool that can be applied, even in confined spaces, during its application and usage in the installation of tubing, within the vehicle, or for any other related type of apparatus.

Heretofore, some tubing straighteners have been aimed towards the automotive repair market, and generally fall into two categories. One is the bench-mounted type of straightener, and the other is the hand-held type of device, for use in tube straightening. The bench-mounted tubing straighteners are adjustable for different tubing diameters, but must be mounted upon the bench-mounted vise, so that the tubing can be pushed or pulled through the wheels of the straightener, in preparation for application. This requires that the user straighten the tubing away from the vehicle, and before it is attached in any manner, to the vehicle, which does add time and require reworking the shaping of the tubing to ensure a proper fit.

Hand-held tubing straighteners do allow the tubing to be straightened when it is attached to the vehicle, however, it can only be attached on one end because the tubing straightener must be inserted onto the tubing, on the other end, which leads towards a predicament in trying to straighten an entire length of tubing, after one of its ends may be already installed. In other words, the hand-held one can only have the tubing applied on its end, and cannot have the tube straightener device applied along the length of the tubing, during its application and usage, as when being installed upon a vehicle, as brake lining. In addition, the hand-held type of tubing straighteners are often not adjustable, requiring the user to buy many different sized tools, for different diameters of tubing, in order to achieve the straightening feature for the lining during installation.

The various types of pipe or tube straightening apparatuses, can be seen in the variety of prior art patents, such as the U.S. Pat. No. 9,751,121, to Murphy, identified as a pipe straightening apparatus and a method of straightening a pipe. Essentially, the device shown within this patent is a pipe straightening apparatus, and the apparatus includes first and second sets of rotatably mounted elements, or wheels, as can be noted. Then, the pipe to be straightened is passed through a first passageway, starting with one end of the pipe, into one end of the apparatus, and the same pipe can also be arranged for passing through a second passageway, and these two arrangements for passage of the pipe tubing to be straightened only allows for the application of the pipe, at one end, to the straightening apparatus, during its usage. This particular device does not allow for the installation of the pipe straightening apparatus onto the pipe to be straightened, anywhere along its length, during its unrolling and usage.

The U.S. Pat. No. 10,005,115, to Badea, et al, is upon a method and process, system, an apparatus for straightening of thin tubular shapes. This is a fairly complex apparatus, appears to be affixed by permanent installation, for use in straightening thin tubular shapes. This is not a hand-held type of device.

The patent to Mandula, Jr., U.S. Pat. No. 3,568,485, shows another method and apparatus for straightening and testing work pieces, in an apparatus formed of a series of angularly affixed rollers.

U.S. Pat. No. 4,534,179, to Woolley, shows a method and apparatus for straightening pipes.

U.S. Pat. No. 5,442,946, to Yokoo, et al, shows a steel stock shaping apparatus.

The published application to Schramm, et al, No. US2002/0162373, is upon a straightening machine for straightening elongated bodies.

U.S. Pat. No. 6,354,126, shows a very complex type of tube straightener and drive therefor.

U.S. Pat. No. 6,494,253, shows a related device.

Design Pat. No. Des. 276,436, shows a design for a hydraulic power combined type and tubing straightener.

U.S. Pat. No. 4,475,373, shows the letters patent upon the previous design.

The patent to Honeycutt, U.S. Pat. No. 4,116,037, shows a tubing sizer and straightener, which is hand-held.

U.S. Pat. No. 5,125,905, shows a guide wire straightener.

U.S. Pat. No. 4,763,504, shows the use of a series of angulated rollers for straightening machines and methods.

A further type of straightening apparatus is shown in U.S. Pat. No. 3,998,083, upon the straightening apparatus, as noted.

There are various apparatuses for use for straightening tubing, such as a bench model type of straightener as shown in the Brakequip model No. BQ1028.

Another form of straightener is shown in the Industro 3-in-1 tube straightener, where the tube must be inserted from the tube end, into the device, for furnishing its straightening, which is like the type of prior art devices as previously explained.

The foregoing are examples of the type of prior art as known to the applicant, relating to this technology.

SUMMARY OF THE INVENTION

As previously stated, the concept of this invention relates to the straightening of tubing, particularly narrow diameter tubing, having some flexibility, and combines the advantages and enhances the improvements obtained of both the bench-mounted and hand-held tools as previously described. This particular invention by being both adjustable, and hand-held, and also able to clamp onto a section of tubing without having to be inserted over the end of the tubing, is quite an enhancement over the rather limited use complex prior art devices used for straightening such tubing.

The concept of this invention differs from others on the market, namely, it is adjustable for multiple sized tubing diameters, and in fact, in the preferred embodiment, can handle seven different tubing diameters, in the category of 3/16", 1/4", 5/16" (~8 mm), 3/8", 6 mm, and 10 mm, in diameters. Furthermore, the tool of this invention is hand-held, and can be clamped onto the middle of the tubing, rather than having to be pushed onto an end, which allows greater flexibility of usage of this device, even during tubing installation, over what is shown in the prior art. This allows users to straighten the tube, while one end may already be previously attached to the vehicle, such as when used in the installation of one end of the brake line to the wheel brakes, while the other end of the tube may still be in the coiled stage, but being unwound and straightened, during installation of a brake line, as one example of the improved usage of this invention.

Hand-held tubing straighteners typically must be inserted onto the end of the tube. Bench-mounted tubing straighteners can clamp onto the middle of the tubing, but these are much more complex, large, and unwieldy of usage. There is no way to use the bench-mounted tubing straighteners for use under a vehicle, while installing brake lines, in-situ.

Typically, a coil of copper-nickel tubing, as used for automotive brake lines, will come in a coiled configuration of approximately 18" in diameter. The tubing is coiled, in this configuration, for delivery or storage purposes.

The concept of the current invention in its preferred method is to utilize a design feature that incorporates four sets of rollers, generally arranged every 90 degrees, in their assembly. The rollers may be adjusted, radially, up and down by pushing of an adjustment ring, in or out, in order to clamp upon a tubing of a particular diameter, in the range as previously described. There is a cover means that covers the entire assembly, but contains usual apertures or holes for verifying proper placement and the size of the tubing diameter being handled. The sets of rollers, in the preferred embodiment, having four rollers in each set, and their being four sets provided around the inner circumference of the straightener, provides for complete securement of the rollers onto the embraced tubing, to be straightened, through usage of the device.

Basically, this tool is formed having a housing, which generally incorporates the various structures that support the operating components of the tool, during its usage. The housing may include an outer covering, which can be circumferentially applied around the tool, or it may incorporate a series of rods or longitudinal members, that are secured to the outer periphery of the housing, and which can be grasped by the user during usage and application of this device as a hand-held tool. The housing will have a quadrant or a sector of its periphery, that is opened, entirely along its length, so that the tool can be applied directly to the tubing being straightened, without necessitating the insertion of any end of the tubing within the tool, in preparation for its usage. The housing, and its various structures, are provided for holding the various operative components of the tool, during their usage and application. For example, the tooling includes the various sets of rollers, as identified, and secures these rollers for their rotational movement, in the tooling, and allows for the rollers to be radially shifted, within the tool, to accommodate the size of the diameter of the tubing being straightened. Furthermore, the housing incorporates an adjuster means, that is operatively associated with at least one end of the housing, and which can be shifted longitudinally within the housing, or pulled outwardly therefrom, when providing for the maneuvering of the rollers, radially, when setting the tool upon the selected but differing sizes of tubing, to be straightened, during usage of said tool.

There is that outer covering for the device, so that it can be conveniently hand-held during usage, but a sector of the device, preferably approximately a quadrant of size, or approximately 90 degrees, more or less, is opened, along the length of the device, so that the straightener can be applied directly onto the tubing, anywhere along its length, and does not have to be applied only by inserting an end of tubing into the device, in preparation for its usage.

The rollers are held by spring loaded means, that connect to the roller mounts or supports, that biases the rollers up against an adjuster means and its surfaces, depending upon the location of the adjuster means in its setting relative to the roller supports and the cover, during the adjustment process. The adjuster means can travel rearwardly or forwardly, longitudinally within the cover of the device, and allows for movement of the rollers from a wider diameter such as a tubing of greater diameter, or the adjuster ring can be slid inwardly, pressuring the roller mounts or supports, closer together, to reduce the size of tubing that can be applied within the sets of rollers, during installation of the device, in preparation for a tube straightening process.

The roller mounts include a series of arms or tabs, that extend radially upwardly, and which bias against the inner surfaces of the adjuster means inclined surfaces, in order to furnish that adjustment of the sets of rollers, relative to each other, and to vary the dimension between the various sets of rollers, to determine the size of tubing that can be located within the device, in preparation for a tube straightening process.

All of the foregoing, in forming the construction of the straightener of this invention, is done within a hand-held type of device, that may be located onto the tubing to be straightened, anywhere along its length, and need not require the insertion of only the ends of the tubing, within the straightener, in preparation for its application. Furthermore, with the built in adjustability between the various sets of rollers that make up the tubing straightener of this invention, various diameter tubing can be processed through use of this straightener device, which, unlike the prior art, greatly adds to the dexterity of usage of this device, in addition to costs reduction, since it can handle tubing of a variety of diameters, that are normally encountered in the tubing field, and more specifically when applied for processing and installation of brake lines, in situ, within any vehicle.

It is, therefore, the principal object of this invention to provide a tubing straightener, and one that can be accommodating for usage with tubing of a wide variety of diameters, all through use of this single straightening tool or apparatus.

Another primary purpose of the current invention is to provide a tubing straightener, that has a sector or quadrant that is opened, throughout its length, so that tubing can be applied into the straightener, in preparation for achieving that result, anywhere along the length of the tubing, and not only be applicable for receiving the end of tubing, in preparation for its straightening function.

Another object of this invention is to provide a hand-held type of tubing straightener, and one that incorporates an adjustment means or ring, that can be used for clamping onto tubing of different diameters, in preparation for its straightening, as unrolled from a coil of such tubing.

A further object of this invention is to provide a tubing straightener which is of singular construction, but can accommodate multi-sized tubing within its assembly, to attain their straightening.

A further object of this invention is to provide a tubing straightener that incorporates an adjustment ring that can be manipulated, longitudinally of the device, for biasing its supported rollers against the surface of the tubing to be straightened, regardless of the range of diameters of the tubing being accommodated therein.

These and other objects may become more apparent to those skilled in the art upon review of the Summary of the Invention as provided herein, and upon undertaking a study of the Description of its Preferred Embodiment, in view of the drawings.

GLOSSARY OF COMPONENTS

1. Outer housing structural frames.
2. Fasteners securing housing frames.
3. Adjuster ring.
4. Tubing to be straightened.
5. Rollers.
6. End frames.
7. Springs.
8. Roller connector or mounts.
9. Clearance slots.
10. Frame slots.
11. Stepped or inclined surfaces.
12. Roller mount tabs.
13. Adjuster ring extensions.
14. Guide screws or pins.
15. Sector opening.
16. Viewing apertures.
17. Straightener outer cover.
18. Bracket mounts.
19. Fasteners
20. Concaved Surface
25. Opening Slots
26. Bearings

DESCRIPTION OF THE PREFERRED EMBODIMENT

Figure 1:
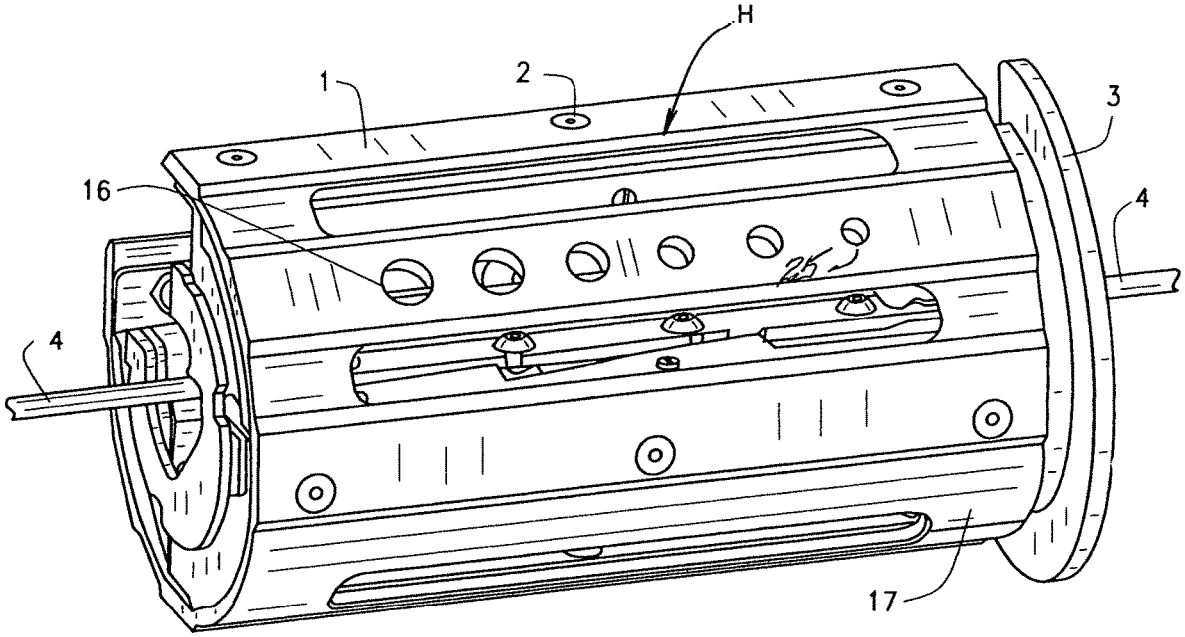
FIG. 1 is an isometric view of the tubing straightener of this invention.
Figure 2:
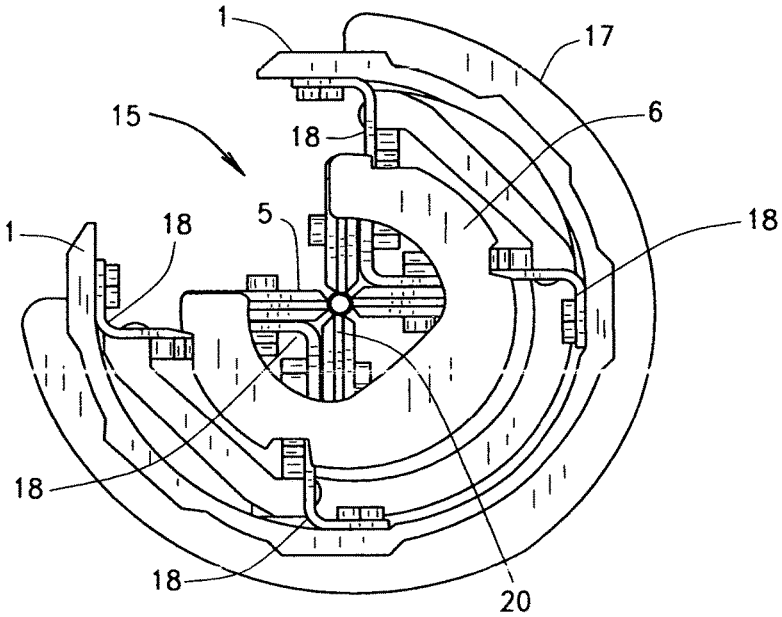
FIG. 2 is a left end view of the tubing straightener of FIG. 1.
Figure 3:
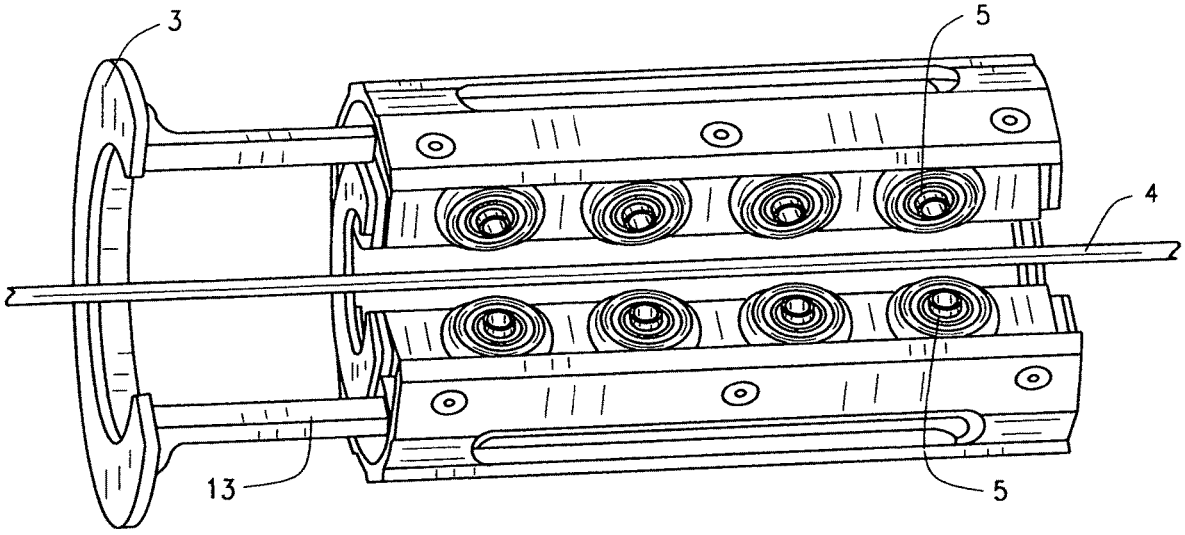
FIG. 3 shows the open sector of the tubing straightener along its length, for this invention, with its adjustment means extending outwardly from its housing, in preparation for its reception and adjustment for clamping onto tubing during performance of the straightening process.
Figure 4:
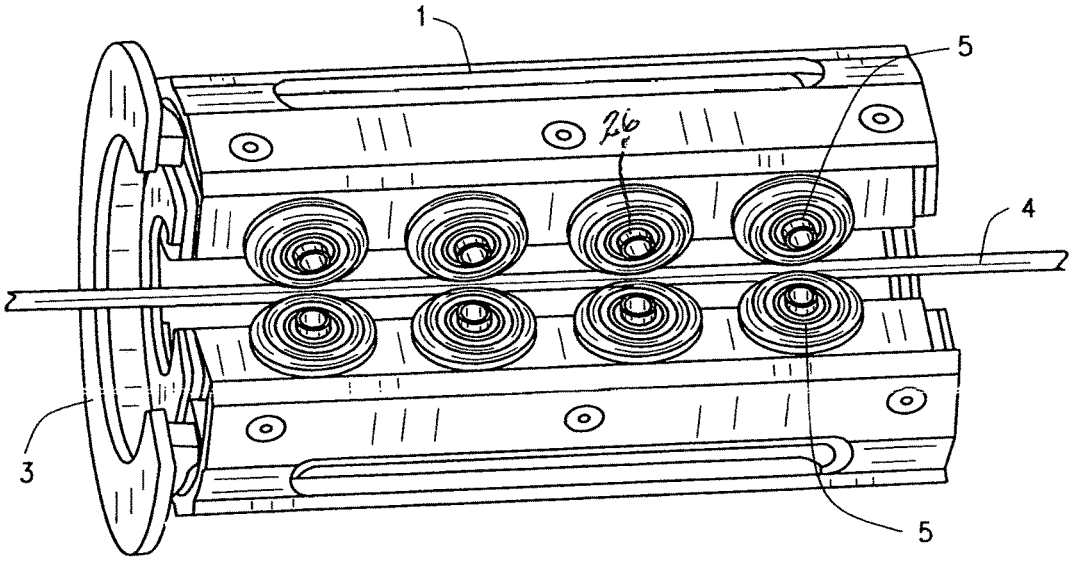
FIG. 4 shows a similar view to that of FIG. 3, with the adjustment means having been pushed inwardly, within the tool housing, and to clamp the various rollers onto the tubing being straightened.

In referring to the drawings, and in particular FIG. 1, the tubing straightener 1 is shown. It has an outer housing H, although the housing does not support operating components—since the tool can function without housing. Housing is mainly cosmetic while providing a means to grip the tool, as well as openings to see inside and for measuring tubing diameters. It is generally of a cylindrical shape, with rollers being mounted to a welded metal frame, to be subsequently described. As can be seen in FIGS. 2-4, there are four sets of rollers 5, generally arranged at 90° angles with respect to each other, and there are four rollers per set, as can be seen in FIGS. 3 and 4, along the longitudinal length of the straightener 1. Thus, there are a total of sixteen rollers in banks of four each, arranged, as stated, at 90° with respect to each other around the axis of the cylindrical shape of the straightener 1. The bearings 26 hold the rollers for rotation.

There are a pair of the plastic covers in the preferred embodiment, one generally provided around the periphery of the straightener, and these covers are attached to the metal frames or brackets 18, of the straightener, by various screws, as noted at 2. The shape of the covers form the outer cylindrical shape for the housing, with an opening in one sector, or quadrant 15, as can be noted in FIG. 2, which allows for the insertion of the tubing 4, to be straightened, and to be inserted into the device, anywhere along the length of the tubing, in the manner as can be noted in FIG. 1 of the drawings.

There is an adjuster means 3, in the form of a ring like member, that protrudes from one end of the straightener, and during functioning, this adjuster ring can be pulled along the longitudinal axis of the device, and its retained tubing, in order to adjust the rollers to embrace different sized tubing, having differing outer diameters, depending upon the size of the tubing being straightened. Obviously, the adjuster means can be to other shapes. As can further be noted, there are holes 16 provided through the outer covering 1 which allows the user to observe the tubing diameter that is located within the device, in preparation for its usage, and which can be used as a way to verify, visually, the diameter of the given piece of tubing inserted into the device, and if the rollers are in contact therein, in preparation for its usage. Openings 25 allow the user to observe and align the tubing, and also serve as a means to grip the tool.

The adjuster ring 3 can be pulled outwardly of the straightener, as can be noted in FIG. 3, which moves the various sets of rollers away from each other, to provide for the most widened dimension and clearance between the rollers to allow for the straightener to accommodate tubing of greater diameters, or the adjuster ring 3 can be pushed inwardly, as noted in FIGS. 4 and 1, in order to move the rollers 5 biasing against the tubing, in preparation for a straightening operation.

The rollers move within vertical slots 17, with each set of the four attached rollers being secured onto the roller connector or mount 8, as noted. And, the roller mounts are pushed outboard, by their associated springs 7, one provided on either end of each mount of the straightener, as can be noted.

There are tabs 12 formed along the roller mounts 8, that extend outwardly, as noted, and these tabs are provided for biasing against the inclined surfaces 11 of the adjuster ring extension 13. Each of the stepped surfaces 11 correspond to a given diameter of tubing, which is selected by the user using visible markings on the exterior of the straightener. When the adjuster ring 3 is pulled fully outwardly, as noted in FIG. 5, the tabs 12 locate at the upper inclined portion of the stepped surface 11, of the extensions, as can be seen, and therefore its associated rollers are urged outwardly, by the influence of the springs 7, to provide for the widest dimension between the various rollers 5, as also can be noted in FIG. 3. Then, as the adjuster ring 3 is pushed inwardly, in the manner as shown in FIG. 6, the tabs 12 are urged inwardly with their integral roller mounts 8, which thereby forces the rollers closer together, in the manner as shown in FIG. 4, with the tabs 12 now riding upon the lower inclined surfaces of the adjuster ring extensions 13, as can be noted in FIG. 6. In this condition, the rollers are urged to their closest point together, as explained, as noted in said FIG. 4.

Figure 5:
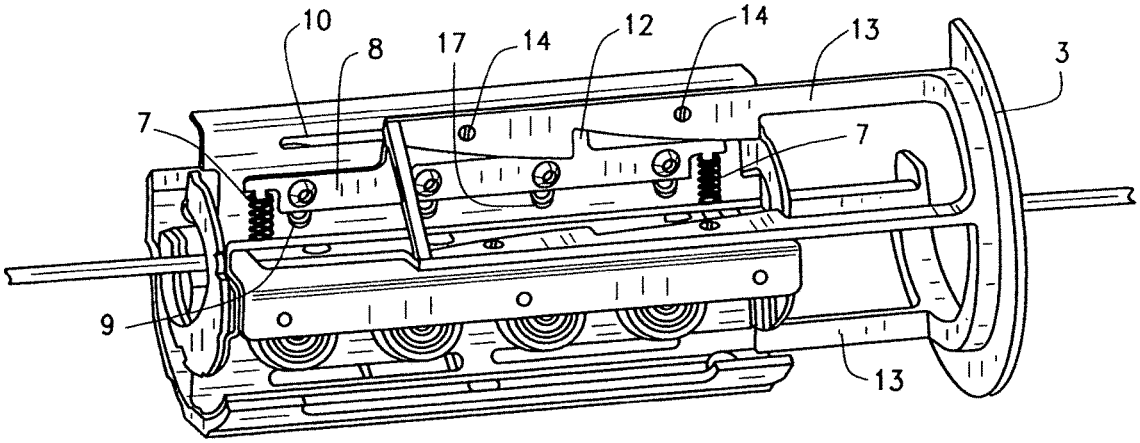
FIG. 5 is a view of the tool, with its cover removed, for showing the adjustor ring and its extensions being shifted outwardly of the housing during its reception of the tubing to be straightened.
Figure 6:
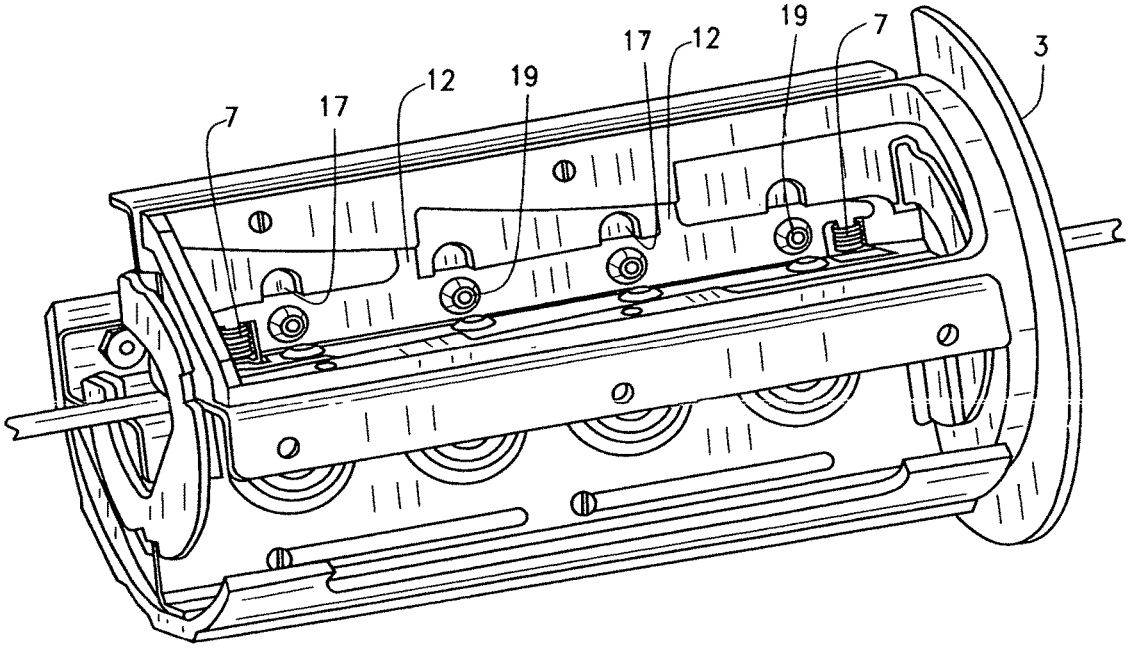
FIG. 6 shows a tool similar to that in FIG. 5, with the adjuster means and its extensions pushed longitudinally inwardly within the housing and biasing the various rollers against the axially placed tubing, to be straightened, applied therein.
Figure 7:
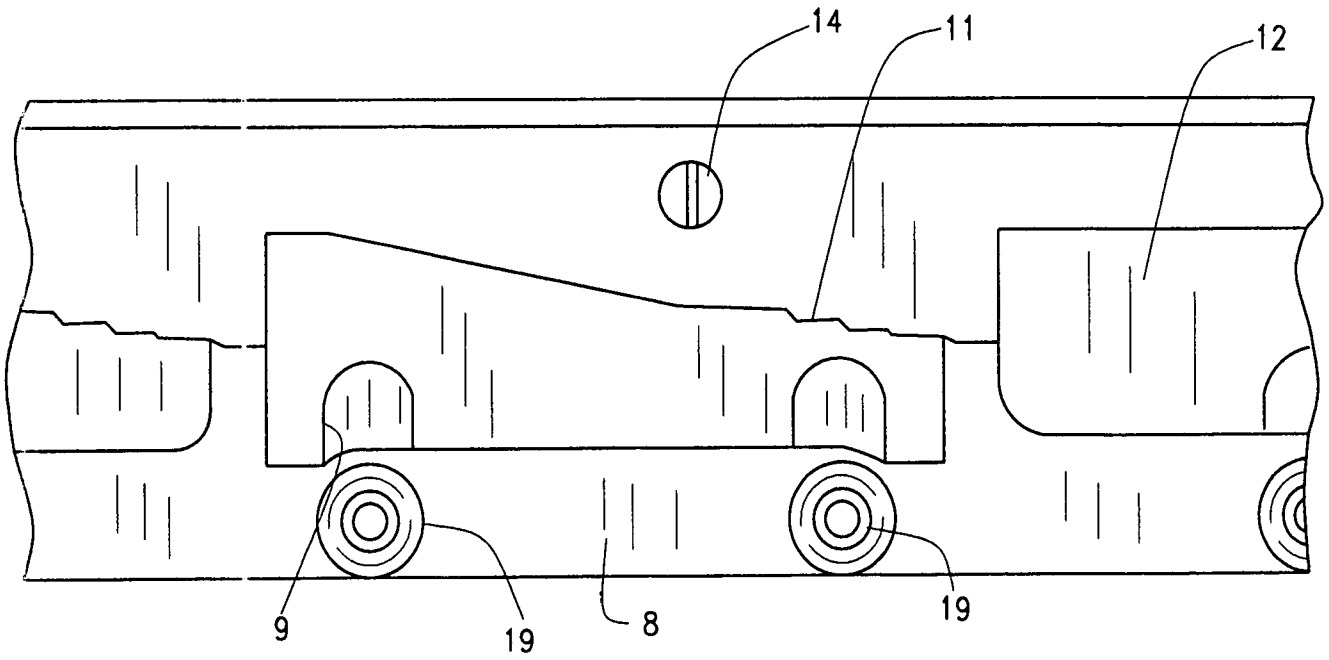
FIG. 7 provides a close up view of the step or inclined surfaces of the adjustment means in which instance the rollers are biased against the surface of the narrower diametered tubing being straightened.

It should be noted that the adjuster ring 3 moves longitudinally within the outer casing or covers 1, guided through the usage of its screws, bearings, or pins 14, riding within their associated slots 10, formed of the outer cylindrical cover 1 and its formed brackets 18, as previously explained, and as shown in FIGS. 5 and 2.

Thus, as can further be noted within FIG. 2, the straightener having its outer plastic covers 17 are secured by the brackets 18, to the metal frames 6, one provided at each end of the straightener. The roller mounts 8 are held in position within the straightener via fasteners 19, and through the use of springs 7, can radially shift within their slots 9, so as to widen the gap between the rollers, or to narrow the same, in the manner as previously described, depending upon the size of the tubing to be straightened. And, the roller mounts 8 are subject to radially shifting inwardly or outwardly, as a result of the longitudinal shifting of the adjuster ring 3, in the manner as previously described. The rollers 5 are secured to their mounts 8 by means of their fasteners 19 and rotate by means of ball bearings 26, which allow for their rotation. Metal frames 6 are welded to brackets 18 as a means of connecting the four metal parts into one unit that forms the framework of the tool.

It can also be seen, from FIG. 2, that the outer perimeter of the rollers form a concaved type surface, as at 20, so as to embrace any circular tubing provided therein, and to allow the rollers to confine and bias against the surface of the tubing, throughout the length of their contact with each set of four rollers, as the tubing is pulled through the straightener, or the straightener is manually forced along the length of the tubing, in order to provide for its straightening, generally from the coil form. Obviously, more or less sets of rollers can be used in this device just so sufficient contact is maintained against the tubing being straightened.

In the alternative view, as previously explained, with respect to FIG. 5, shown with one of the covers removed, to provide for the viewing of the mechanism more clearly, when the roller mount 8 is pushed radially outwardly by the springs 7, one on either end, as noted, the tabs 12 that protrude from the roller mounts 8, such that these tabs interact with the stepped or inclined surfaces 11 of the adjuster extensions 13, as noted. The rollers then will move outboard, normal to the tube axis via the slots 9, in order to widen the clearance for accommodating a greater diameter tubing within the straightener, in preparation for its usage. The integral ring extensions 13 of the adjuster ring 3 are attached to the metal frame, through the slots 10, as previously explained, and thus it limits the travel of the adjuster ring, fore and aft, along the longitudinal axis of these slots 10, and the straightener itself.

In a related view, but with the tubing straightener clamped onto the tubing 4, and with the adjuster ring being pushed inboard to clamp the rollers onto the tubing, as can be seen in FIG. 4, in this position, the smallest diameter tubing that can be straightened by use of the tool is applied therein. The rollers, in this condition, have been moved inboard via their slots 9, and the adjuster ring has moved inwardly, of the device, in the manner as shown in said FIGS. 4 and 6.

Hence, as can be seen from the description herein, that this tubing straightener device is a hand-held type of apparatus, and because of its sector clearance area 15, can be clamped onto tubing of various diameters, simply through the manipulation of its adjuster ring 3, either inwardly, or outwardly, in the manner as previously described, to allow for straightening of tubing of various sizes, through the use of this hand-held device, that can be applied anywhere along the length of the uncoiling tubing, at any location, during its usage in straightening such tubing during its installation within, for example, a vehicle, when replacing brake lines, during assembly or repair.

Variations or modifications to the subject matter of this invention may occur to those skilled in the art upon review of the development as explained herein. Such variations, if within the spirit of this invention, are intended to be encompassed within the scope of any claims to patent protection issuing herein. The description of the invention within the summary, and within the preferred embodiment, and its depiction within the drawings, are all set forth for illustrative purposes only.

I claim:

1. A tool for functioning as a tubing straightener for straightening tubing unwinding from a coiled roll, said tool comprising:

a housing, said housing incorporating a pair of end frames, said end frames being longitudinally spaced apart;

an outer cover formed of the housing and surrounding the tool and its end frames;

a series of brackets retaining the end frames to the outer cover of the housing;

a series of roller mounts shiftably connected to the brackets, each roller mount holding a series of rollers, which along with the roller mounts are capable of radially shifting within the tool during its adjustment for biasing the rollers onto the tubing during performance of a tube straightening process;

an adjuster means provided proximate one end frame of said tool, a series of adjuster extensions integral of the said adjuster means, and said adjuster extensions slidingly attached to said brackets and biasing against said roller mounts to urge said series of rollers against the tubing, when said adjuster means and their adjuster extensions are shifted longitudinally within the tool housing during its set up for usage.

2. The tool of claim 1, wherein said outer cover and said brackets have a sector that opens along the length of the housing to provide clearance for installation of any tubing along the length of said tubing within the tool in preparation for its usage in tube straightening.

3. The tool of claim 2, wherein said roller mounts are biased radially outwardly of said tool, and said adjuster extensions having an inclined surface bearing against said roller mounts, wherein said roller mounts are urged inwardly of said tool forcing said rollers and roller mounts radially inwardly of said tool to bias the rollers against the tubing being straightened.

4. The tool of claim 2, wherein the adjuster extensions incorporating at least one inclined surface for biasing against the roller mounts which when said adjuster means is shifted longitudinally inwardly or outwardly of said tool the rollers shift radially inwardly or outwardly to narrow or widen the opening between the rollers to accommodate tubing of different diameters for the straightening process.

5. The tool of claim 2, wherein there are four roller mounts included in said tool, and there are at least two rollers securing to each roller mount.

6. The tool of claim 5, wherein each roller mount is arranged approximately 90 degrees with respect to each adjacent roller mount.

7. The tool of claim 5, wherein there are four rollers securing to each roller mount.

8. The tool of claim 3, wherein each roller mount having at least one extending tab, said tab biasing against the inclined surface of the associated adjuster extension, whereby when said adjuster means is longitudinally shifted in said tool, the inclined surface of the adapter extension biasing against the roller mount tab, and urging the rollers into a narrowing or widening distance between the series of rollers for varying the size of tubing to be straightened by the tool during usage.

9. The tool of claim 1, wherein the tool is hand-held during application.

10. The tool of claim 1, wherein said cover includes at least one aperture for allowing the user of the tool to observe the size of the tubing and the contact of its rollers against said tubing during performance of a straightening process.

11. The tool of claim 1, wherein each bracket includes a longitudinal slot, each adjuster extension having a bearing provided thereon, and arranged for riding within its associated bracket slot, to keep the adjuster means in longitudinal alignment within the tool during its shifting inwardly or outwardly of the tool housing, during application.

12. A tool for functioning as a tubing straightener for straightening tubing unwinding from a coiled roll, said tool comprising:

a housing formed from components for providing support for handholding of the tool during performance of a tube straightening, and said components provided for holding the operative components for biasing against and securement of the tube within the housing during its straightening process, said housing having a longitudinal central axis wherein the tubing to be straightened locates in preparation for a tube straightening procedure;

a series of roller mounts shiftably connected in said housing, each said roller mount securing at least a pair of rollers rotatably thereto, and each roller mount and their rollers capable of radially shifting towards and away from the central axis of said housing when adjusted for holding different sized tubing in preparation for the straightening process;

said housing having a pair of ends, and an adjuster means provided proximate at least one end of said housing, said adjuster means having a series of adjuster extensions integral of said adjuster means, and said adjuster extensions slidably attached to said housing and bearing against said roller mounts to urge said series of rollers against the tubing as said adjuster means and its adjuster extensions are shifted longitudinally within the housing in preparation for its usage in straightening different sized tubings during its usage.

13. The tool of claim 12, wherein said housing includes a pair of end frames, a series of brackets securing between the end frames, there being an outer structure surrounding the end frames and brackets to form the housing, and said roller mounts being shiftably connected to said brackets for radial movement within the housing, and said adjuster means and integral extensions being mounted to said brackets for longitudinally shifting within said housing during its adjustment for locating various sized tubing along the housing central axis in preparation for the straightening of said tubing as it unrolls from the coiled form.

14. The tool of claim 12, wherein springs are provided for biasing the roller mounts radially outwardly of said tool.

* * * * *